US005145410A

United States Patent [19]

Maejima et al.

[11] Patent Number: 5,145,410

[45] Date of Patent: Sep. 8, 1992

[54] WATERPROOF CONNECTOR

[75] Inventors: Toshiro Maejima; Kazuaki Sakurai; Seiji Kozono; Mitsuhiko Totsuka; Toshiharu Kudo, all of Shizuoka, Japan

[73] Assignee: Yazaki Corporation, Japan

[21] Appl. No.: 727,928

[22] Filed: Jul. 10, 1991

[30] Foreign Application Priority Data

Aug. 6, 1990 [JP] Japan ..... 2-82727[U]

[51] Int. Cl.[5] ..... H01R 13/40

[52] U.S. Cl. ..... 439/587; 439/274; 439/279

[58] Field of Search ..... 439/271, 274, 275, 278-283, 439/587, 272, 273

[56] References Cited

U.S. PATENT DOCUMENTS

| | | | |
|---|---|---|---|
| 4,090,759 | 5/1978 | Herrmann, Jr. | 439/279 |
| 4,214,802 | 7/1980 | Otani et al. | 439/275 |
| 4,497,531 | 2/1985 | Baker | 439/271 |
| 4,998,896 | 3/1991 | Lundergårn | 439/274 |

FOREIGN PATENT DOCUMENTS

| | | | |
|---|---|---|---|
| 2603374 | 2/1988 | France | 439/275 |
| 62-198064 | 9/1987 | Japan . | |
| 8705157 | 8/1987 | PCT Int'l Appl. | 439/275 |

*Primary Examiner*—David Pirlot
*Attorney, Agent, or Firm*—Wigman & Cohen

[57] ABSTRACT

A waterproofing connector including a housing provided with a plurality of chambers in which wiring harnesses are fixed and with a rigid grid consisted of plates for partitioning the chambers, and a seal for sealing an end of the housing, the seal being provided with a plurality of holes in which the wiring harnesses are passed through to the chambers and with grooves for partitioning the holes. The plates of the rigid grid are inserted securely in the grooves of the seal respectively when the end of the housing is covered by the seal. The holes of the seal do not deform nor shift from chambers of the housing when the seal is put in the housing for sealing and when wiring harnesses are passed through the holes to the chambers, and good waterproofness is obtained between the holes and the wiring harnesses.

5 Claims, 2 Drawing Sheets

WATERPROOF CONNECTOR

BACKGROUND OF THE INVENTION

The present invention relates to a waterproof electrical connector in which splicers are sealed.

In the prior art, a first and second connectors are engaged with each other while an O-ring is disposed for waterproofing between the connectors. In addition, each connector is provided with a seal at a proximal or rear end. Wiring harnesses with male splicers are passed through holes formed in the seal, and the male splicers are positioned in a housing of the first connector. The second connector also includes wiring harnesses with female splicers. The male splicers of the first connector are connected to the female splicers of the second connector when the two connectors are engaged with each other.

Here, the above mentioned connectors are explained with reference to FIGS. 6 to 8.

FIG. 6 is a perspective view showing a conventional connector or the above-mentioned second connector 5 having female splicers 21 to which wiring harnesses 17 are fixed. Only one wiring harness 17 with a female splicer is shown in FIG. 6 to simplify the drawing. The connector 5 mainly consists of a housing 11 and a seal 7. The housing 11 has a hood 3 at a proximal end, and the seal 7 is put in the hood 3. For making it easy to understand the structure of the connector 5, the housing 11 and the seal 7 are shown as being separated from each other in FIG. 6.

A block 9 is disposed in the housing 11, and a plurality of chambers or holes 13 are formed in the block 9. On the other hand, a plurality of holes 19 are formed in the seal 7 in the same arrangement as the chambers 13 of the block 9. The wiring harnesses 17 with the female splicers 21 are passed through the holes 19, and the female splicers 21 are positioned and fixed in the chambers 13. The female splicers 21 are to be connected to male splicers of the above-mentioned first connector.

A plurality of ribs *7a* are formed around the seal 7 for waterproofing between the hood 3 of the housing 11 and the seal 7 as shown in FIGS. 6–8. Furthermore, as shown in FIG. 7, a plurality of annular ribs *7b* are formed on an inner surface of each hole 19 of the seal 7 for waterproofing between the seal 7 and the wiring harness 17 which goes through the hole 19.

Now, assembling of the second connector 5 is described. First, the seal 7 is pressed in directions X and Y as shown in FIG. 8 and is put in the hood 3 of the housing 11. The seal 7 put in the hood 3 is still compressed in the directions, because the size of the seal 7 is usually designed to be bigger than a space in the hood 3 to obtain good waterproofness. The holes 19 of the seal 7 are superimposed on the chambers 13 disposed in the housing 11 at this time as shown in FIG. 7. Then, several wiring harnesses 17 are passed through the holes 17 of the seal 7, and the female splicers 21 are introduced in the chambers 13 of the housing 11 and fixed there by a known device (not shown). At this time, sealing is kept between the wiring harnesses 17 and the holes 19 by means of the annular ribs *7b*.

However, if further splicers are inserted in the holes 19 and introduced in the chambers 13 in turn from one side of the seal 7 as shown in FIG. 8, force is caused to move the seal 7 towards remaining holes 19. As a result, the remaining holes 19 shift from the corresponding chambers 13. Therefore, further wiring harnesses 17 can not be introduced into the chambers 13 through the holes 19.

By the way, to obtain good waterproofness, the seal 7 is compressed in the direction X and Y in the hood 3 so that the ribs *7a* around the seal 7 and the annular ribs *7b* on the inner surfaces of the chambers 13 can be pressed against the hood 3 and the wiring harnesses 17 respectively. Therefore, the holes 19 are deformed, and subsequently shifted from the corresponding chambers 13 before insertion of wiring harnesses 17 through the holes 19.

Even if the wiring harnesses 17 could be forced to pass through the shifted holes 19 and got into the corresponding chambers 13, seals are broken between the wiring harnesses 17 and the holes 19 because the holes 19 are deformed.

Above description is made for the second connector, and however it is quite same for the first connector.

To prevent such shifts, a device is indicated in Japanese Patent A62-198,064. In the patent, a plurality of protuberances are arranged on a block which has chambers and is disposed in a housing, while a seal in which holes are formed is provided with a plurality of depressions. The depressions are engaged by the protuberances to prevent shifts of the holes of the seal from the chambers when wiring harnesses are inserted through the holes to the chambers.

Notwithstanding the disposition of the device, however, some holes of the seal shift due to shearing force induced by insertion of wiring harnesses.

As mentioned above, in the conventional connectors, it is difficult or impossible to get the wiring harnesses 17 through the holes 19, or good waterproofness can not be obtained.

SUMMARY OF THE INVENTION

It is therefore the object of the present invention to provide an improved waterproof connector to overcome the above-mentioned problem.

To accomplish the above object, the waterproof connector of the present invention includes a housing provided with a plurality of chambers in which wiring harnesses are introduced and fixed and with a grid consisting of plates for partitioning the chambers; and a seal for sealing an end of the housing, the seal being provided with a plurality of holes in which said wiring harnesses are passed through to be fixed in the chamber and with grooves for partitioning said holes. The plates of the grid are inserted securely in the grooves respectively when the end of the housing is covered by the seal.

Since the connector of the present invention is constructed as mentioned above, the holes of the seal do not deform nor shift from the chambers of the housing when the seal is put in the housing for sealing and when wiring harnesses are passed through the holes into the chambers to be fixed.

DESCRIPTION OF THE PREFERRED EMBODIMENT

Now, the present invention is explained in detail with reference to the accompanying drawings.

Figure 1:
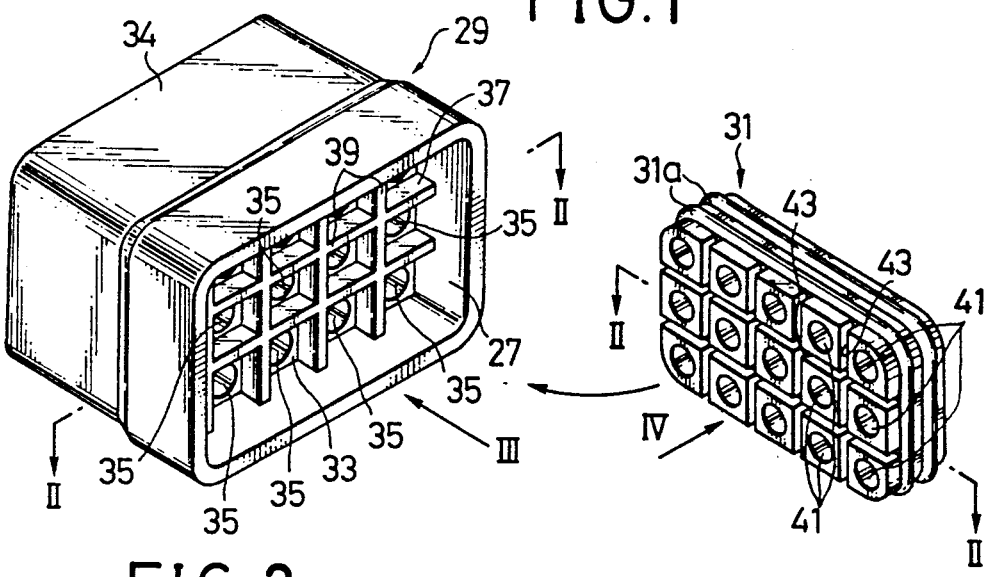
FIG. 1 is a perspective view of a connector of the present invention, showing components of the connector.

In FIG. 1, a connector 29 of the present invention is shown. The connector 29 has a housing 34 and a seal 31. The seal 31 is put in the housing 34 at a rear end of the housing.

Figure 2:
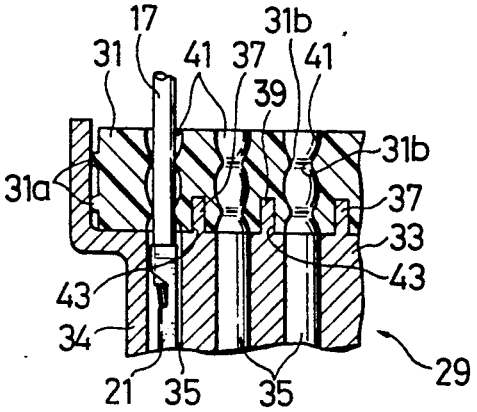
FIG. 2 is a section along the line II in FIG. 1.
Figure 3:
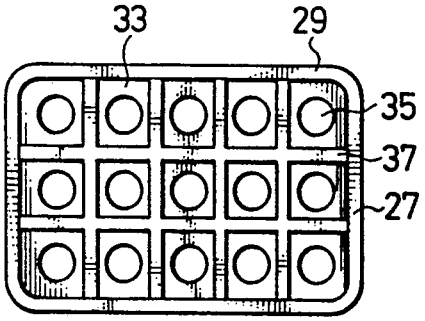
FIG. 3 is a rear view of a housing of the connector taken on an arrow III in FIG. 1.
Figure 5:
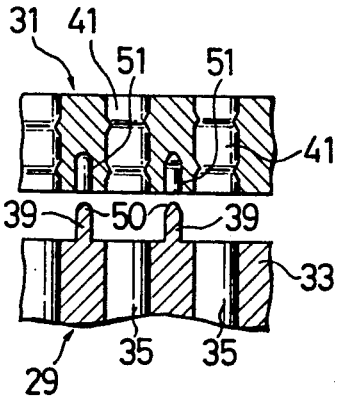
FIG. 5 is an enlarged sectional view showing engagement of the seal with the housing.

In FIGS. 1-3, a block 33 is fixed in the housing 34, and a plurality of horizontal chambers 35 are formed in the block 33. The housing 34 has a hood 27 at the rear end. A rigid grid 37 consisting of cross plates 39 is fixed securely to the block 33 and the hood 27. The grid 37 partitions the chambers 35.

Figure 6:
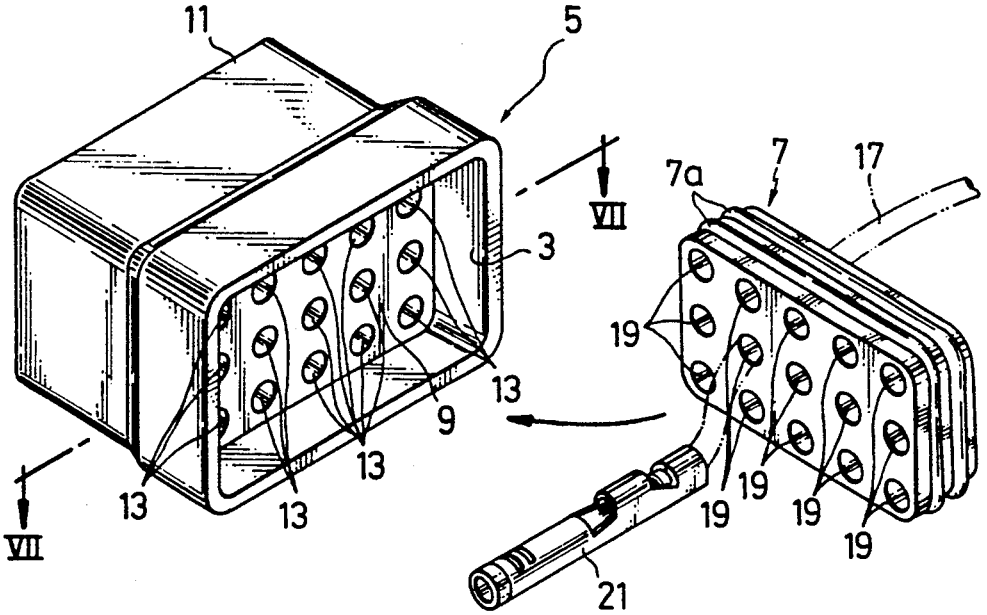
FIG. 6 is a perspective view of a conventional connector including a housing, a seal, and wiring harnesses.
Figure 7:
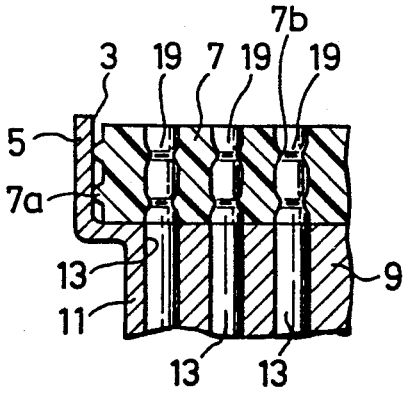
FIG. 7 is a horizontal sectional view of the conventional connector shown in FIG. 6, taken along the section line VII.
Figure 8:
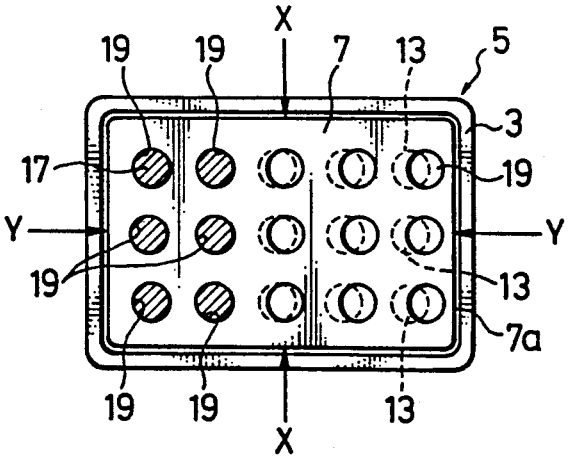
FIG. 8 is a rear view of the conventional connector shown in FIG. 6 showing shifts of holes disposed in the seal from chambers of the housing.

The seal 31 is put in the hood 27 as shown in FIG. 2. The seal 31 is made of elastic material and has a plurality of holes 41 arranged to superimpose the chambers 35 disposed in the block 33. A plurality of wiring harnesses (not shown) are to be passed through the holes 41 into the chambers 35 (FIG. 6) and splicers of the harnesses are fixed in the chambers 35 in a conventional manner. The seal 31 is provided with circumferential ribs 31*a* and annular ribs 31*b* in a conventional manner for enhancing the waterproofness. A plurality of grooves 43 are formed on a frontal surface of the seal 31 for partitioning the holes 41.

The plates 39 of the grid 37 are securely inserted in the grooves 43 of the seal 31 when the seal 31 is put in the hood 27 for engagement with the housing 34 as shown in FIG. 2. Each of the plates 39 has preferably a tip 39 which may be circular, round, pointed, tapered or conical.

Figure 4:
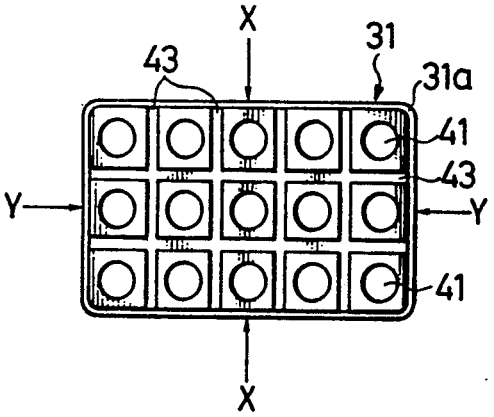
FIG. 4 is a front view of a seal of the connector taken on an arrow IV in FIG. 1.

When the seal 31 is put in the housing 34, the seal 31 is compressed in both directions X and Y (FIG. 4) as described above. At this time, the holes 41 do not deform, because the holes 41 are partitioned by the grooves 43, and because the plates 39 of the rigid grid 37 are inserted securely in the grooves 43. In addition, thanks to the rigid grid 37 fixed in the housing 34, the holes 41 do not shift from the chambers 35 even if force is caused to move the holes 41 when the wiring harnesses are passed through the holes 41. Therefore, all the wiring harnesses can be passed through the holes 41 and introduced into the chambers 35 with ease.

We claim:

1. A waterproofing connector comprising:

a housing having a grid consisting of a plurality of interconnected cross plates defining a plurality of chambers in which wiring harnesses are fixed, each of said cross plates including a transverse edge extending therefrom;

a seal for sealing an end of said housing, said seal having a plurality of holes in which said wiring harnesses are passed through to said chambers and interconnected cross grooves formed on a surface thereof for separating said holes from one another; and wherein said transversely extending edges of said cross plates of said grid are securely engaged in respective cross grooves of said seal when said seal is inserted in said end of said housing, thereby preventing said holes from deforming and shifting relative to said chambers when said wiring harnesses are passed sequentially through said holes into said chambers.

2. A waterproofing connector of claim 1, wherein said holes in said seal are arranged to superimpose said chambers in said housing respectively.

3. A waterproofing connector of claim 1, wherein said chambers and said grid are fixed rigidly in said housing, and wherein said grid is made of rigid material.

4. A waterproofing connector of claim 1, wherein each of said plates of said grid has a tip.

5. A waterproofing connector of claim 1, wherein each of said chambers is sealed from the others.

* * * * *